United States Patent [19]

Heiney et al.

[11] Patent Number: 4,897,041

[45] Date of Patent: Jan. 30, 1990

[54] ELECTRICAL CONNECTOR HAVING A CABLE TERMINATING COVER RETENTION SYSTEM AND A STRAIN RELIEF THEREFOR

[75] Inventors: Francis M. Heiney; Joseph W. Young, both of Harrisburg, Pa.

[73] Assignee: AMP Incorporated, Harrisburg, Pa.

[21] Appl. No.: 326,599

[22] Filed: Mar. 21, 1989

[51] Int. Cl.[4] ..... H01R 4/24

[52] U.S. Cl. ..... 439/404

[58] Field of Search ..... 439/404, 405, 417, 418

[56] References Cited

U.S. PATENT DOCUMENTS

| | | | |
|---|---|---|---|
| 3,820,055 | 6/1974 | Huffnagle et al. . | |
| 4,025,142 | 5/1977 | Huber et al. . | |
| 4,359,257 | 11/1982 | Lopinski et al. . | |
| 4,412,714 | 11/1983 | Morningstar et al. . | |
| 4,475,786 | 10/1984 | Root et al. . | |
| 4,484,791 | 11/1984 | Johnson | 439/404 |
| 4,496,207 | 7/1985 | Ensminger | 439/404 |
| 4,538,873 | 9/1985 | Worth . | |
| 4,621,885 | 11/1986 | Szczesny et al. . | |
| 4,655,528 | 4/1987 | Groft . | |
| 4,668,039 | 5/1987 | Marzili . | |
| 4,681,382 | 7/1987 | Lockard | 439/92 |
| 4,693,533 | 9/1987 | Szczesny et al. | 439/350 |

OTHER PUBLICATIONS

Japanese Abstract: Flat Cable Connector.
Pps. 10–11 of Ansley Catalog.

*Primary Examiner*—Gary F. Paumen
*Attorney, Agent, or Firm*—David L. Smith

[57] ABSTRACT

An electrical connector (20) for terminating a multiconductor cable (62) includes a housing (22) having a cable receiving face (28), opposed side walls (30,32) and an end wall (36). The end wall (36) has protrusions (64,66,68) extending outwardly therefrom. The first protrusion (64) is located adjacent the cable receiving face (28), centrally located with respect to the side walls (30,32). The lower surface (70) of the first protrusion (64) defines a latching surface. Second (66) and third (68) protrusions are located adjacent respective side walls (30,32), remote from the cable receiving face (28), with each of the second (66) and third (68) protrusions defining a sloped surface (82,84) angled toward the other protrusion, and a latch shoulder (96,98). A terminating cover (24) has a pair of spaced latch arms (124,126) depending therefrom, and an inner surface (114) for engaging a ribbon cable (62) terminated in the housing (22). The latch arms each have first (140,142) and second (168,170) latch means adjacent distal ends. In a first position, the first latch means (140,142) on each latch arm (124,126) engages the latching surface (70) of the first protrusion (64) and the distal end (172,174) engages a respective sloped surface (82,84) on one of the other protrusions (66,68) such that the inner surface (114) of the terminating cover (24) is spaced from the cable receiving face (28) to permit insertion and alignment of the cable (62). The terminating cover (24) is movable from the first position, toward the cable receiving face (28) to terminate cable (62) to the housing (22), to a second position. The terminating cover (24) is secured to the housing (22) in a terminated condition at the second position, with the second latch means (168,170) of each latch arm (124,126) engaging a respective latch shoulder (96,98).

20 Claims, 8 Drawing Sheets

108
122
112
24
106
120
110
126
104
116
114
188
124
144
146
54
52
56
58
46
44
50
48
38
42
40
34
32
28
64
84
22
88
30
68
26
36
66
20

ELECTRICAL CONNECTOR HAVING A CABLE TERMINATING COVER RETENTION SYSTEM AND A STRAIN RELIEF THEREFOR

BACKGROUND OF THE INVENTION

This invention relates to electrical connectors and in particular to a cable terminating cover retention system in which the cable terminating cover may be secured to the connector housing in a pretermination position, the terminating cover being movable from the pretermination position toward the connector housing to terminate a cable.

Prior art connectors have typically held terminating covers on a connector housing in a pretermination position by protrusions or ribs which sheared off when the terminating cover was moved from the pretermination position to a termination position and in the process terminated a cable on the connector, as taught by U.S. Pat. Nos. 4,655,528 and 4,475,786.

It would be desirable to have a terminating cover that could be secured to a connector housing in a pretermination position so that a cable could be positioned for insulation displacement termination therein, then moved to terminate the cable without requiring a portion of the terminating cover to fail.

SUMMARY OF THE INVENTION

In accordance with the invention, an electrical connector for terminating a multiconductor cable includes a housing having a cable terminating face, opposed side walls and an end wall. The end wall has a plurality of protrusions extending outwardly therefrom. The first protrusion is located adjacent the cable receiving face, centrally located with respect to the side walls. The lower surface of the first protrusion defines a latching surface. Second and third protrusions are located adjacent to respective side walls, remote from the cable receiving face, with each of the second and third protrusions defining a sloped surface angled toward the other protrusion in a direction away from the cable receiving face. Each of the second and third protrusions defines a latch shoulder. A terminating cover has a pair of spaced latch arms depending therefrom and extending to distal ends. The terminating cover has an inner surface for engaging a ribbon cable terminated in the housing. The latch arms each have first and second latch means adjacent the distal ends. The terminating cover is capable of being secured to the housing in first and second positions. In the first position, the first latch means on each latch arm engages the latching surface of the first protrusion and the distal end engages a respective sloped surface on one of the other protrusions such that the inner surface of the terminating cover is spaced from the cable terminating face to permit insertion and alignment of the cable for termination. The terminating cover is movable from the first position toward the cable receiving face to terminate a cable to the housing. The terminating cover is secured to the housing in a terminated condition at the second position, with the second latch means of each latch arm engaging a respective latch shoulder.

DESCRIPTION OF THE PREFERRED EMBODIMENT

Figure 1:
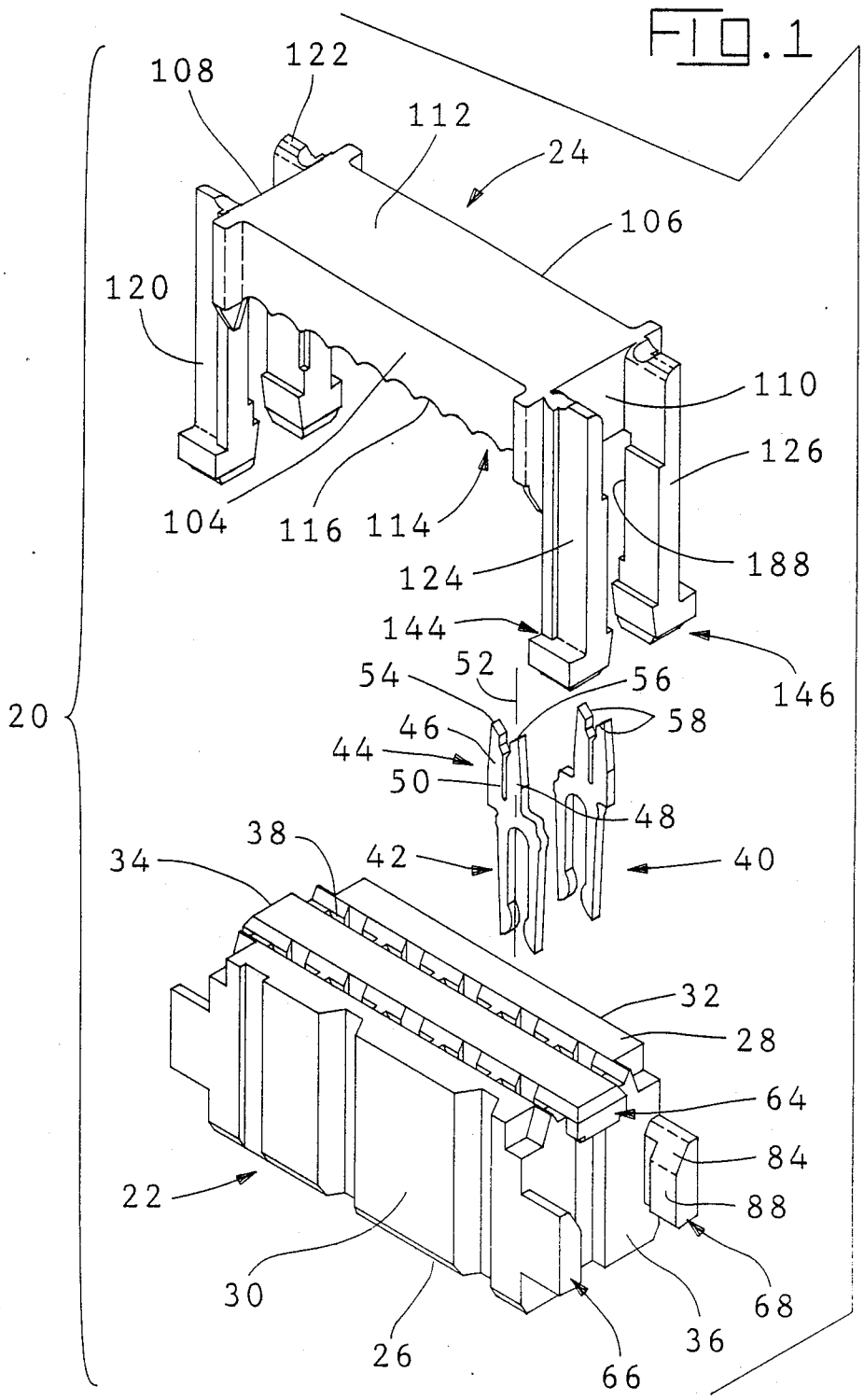
FIG. 1 is an exploded, isometric view of an electrical connector in accordance with the present invention.

An electrical connector 20 in accordance with the present invention is shown in FIG. 1. Connector 20 includes housing 22 and terminating cover 24 both molded of a thermoplastic material. Housing 22 has forward mating face 26, opposed conductor receiving rear face 28, opposing side walls 30,32 and opposing end walls 34,36. Side walls 30,32 define major edges and end walls 34,36 define minor edges along faces 26,28. Contact receiving passages 38 extend between faces 26 and 28 with contacts 40 secured therein, such as by an interference fit. Each contact 40 has a mating portion 42 at one end, shown in the preferred embodiment as a receptacle, and an insulation displacement plate 44 at the other end. Plate 44 includes a pair of spaced arms 46,48 defining a conductor receiving slot 50 therebetween that is substantially parallel to the axis 52 of contact 40. Arms 46,48 extend beyond the cable receiving rear face 28 to respective insulation piercing points 54,56 at the distal ends thereof. Tapered lead-in surfaces 58 angle toward conductor receiving slot 50 to assist in guiding a conductor into slot 50 during termination. Contacts 40 are spaced appropriately in one or more rows and may be staggered from one row to the adjacent row, as is known in the art to terminate conductors 60 of a ribbon cable 62.

Figure 2:
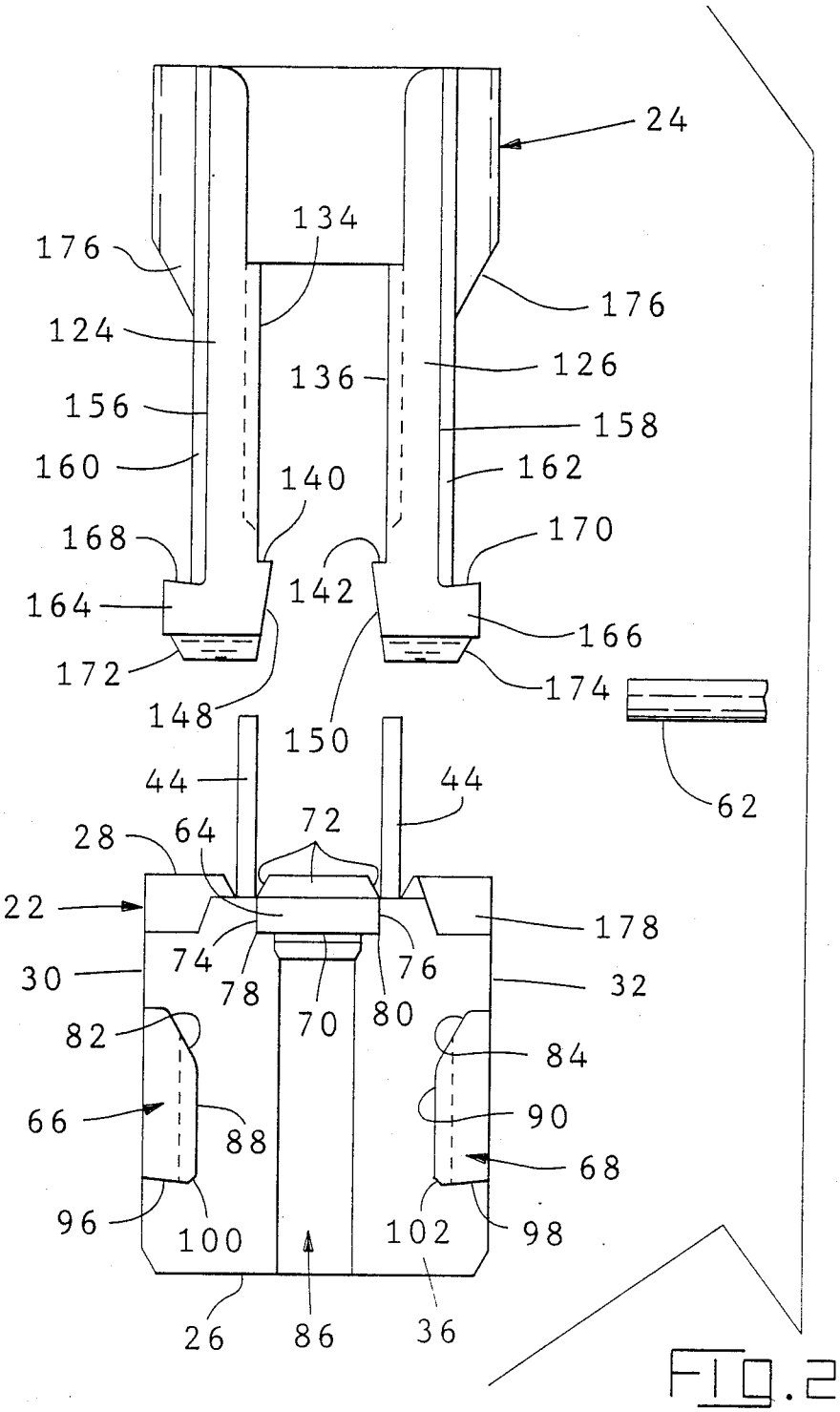
FIG. 2 is an end view of the electrical connector of FIG. 1 with the terminating cover exploded from the housing.
Figure 3A:
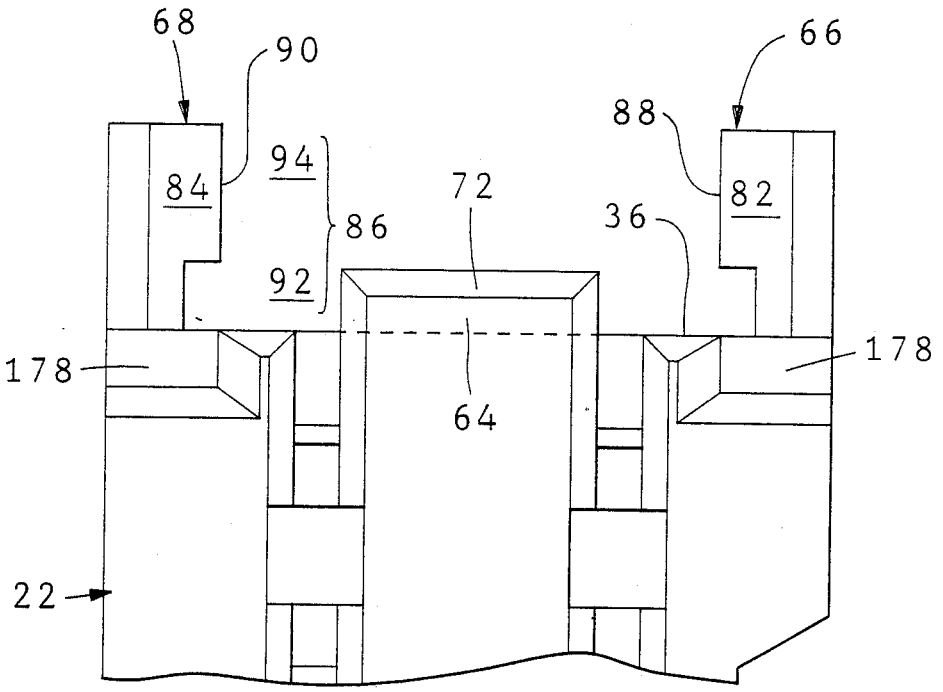
FIG. 3A is a view of the leg receiving channel formed by protrusions on an end wall of the connector housing.
Figure 3B:
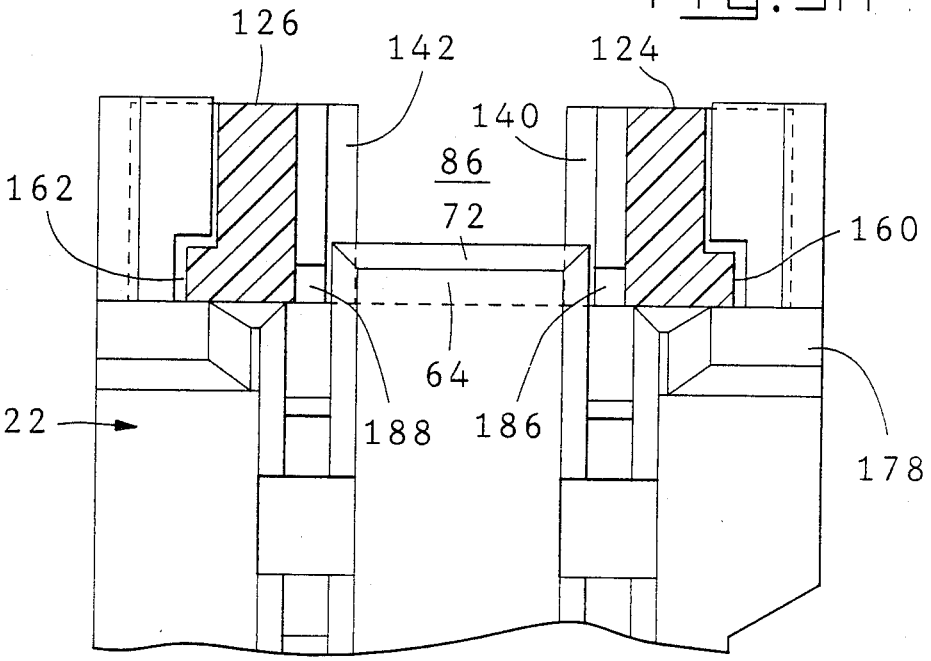
FIG. 3B is a view of the leg receiving channel with legs received therein.
Figure 4:
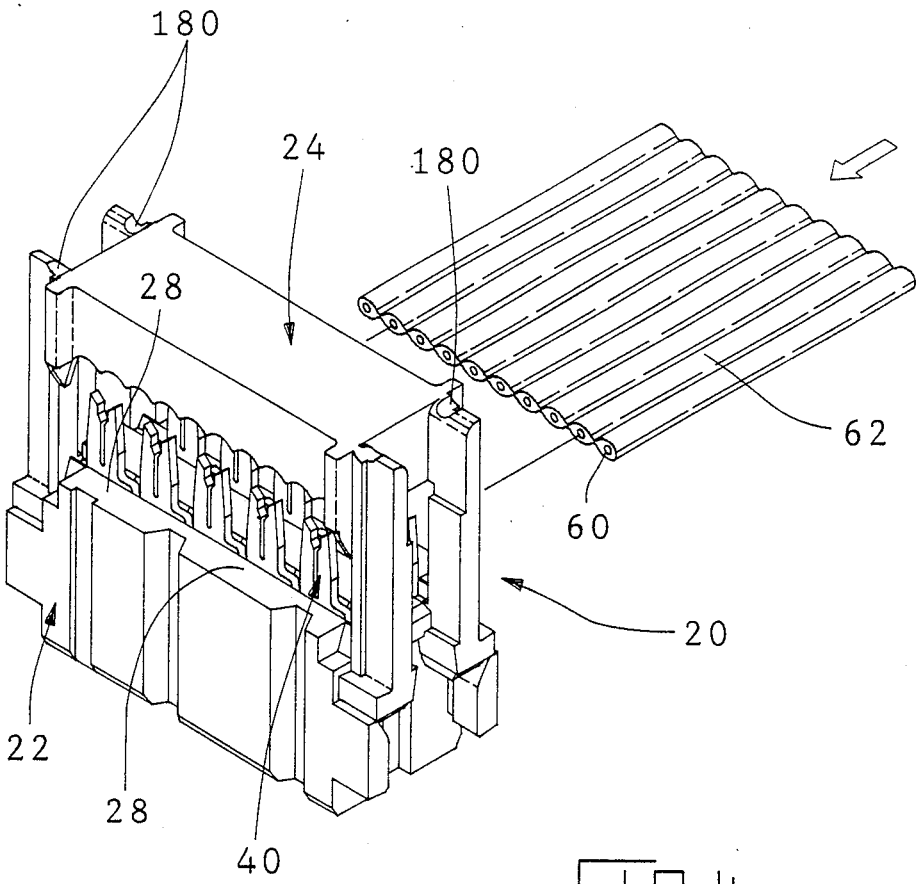
FIG. 4 is an isometric view of the electrical connector with the terminating cover secured to the housing in a pretermination position.

As best seen in FIG. 2 with respect to end wall 36, end walls 34,36 have a latching center protrusion 64 proximate face 28, and outer retaining protrusions 66,68 proximate side walls 30,32. Protrusions 64,66 and 68 cooperate with complementary latch means on terminating cover 24 to secure terminating cover 24 to housing 22. Center protrusion 64 provides latching surface 70 facing mating face 26 and chamfer 72 toward face 28, and defines side edges 74,76 and respective corners 78,80 where side edges 74,76 intersect latching surface 70.

Retaining protrusions 66,68 define respectively ramped surfaces 82,84. A leg receiving channel 86 is defined between retaining protrusion 66,68. Each retaining protrusion 66,68 has an undercut portion 88,90 resulting in channel 86 having a wider region 92 adjacent end wall 36 and a narrower region 94 spaced from end wall 36. Although channel 86 is shown having a generally T-shaped cross-section, undercut portions 88,90 could be tapered resulting in a trapezoidal cross-section for channel 86, and be functionally equivalent. Retaining protrusions 66,68 include outwardly upwardly sloped latch shoulders 96,98 defining respectively corners 100,102.

As best seen in FIG. 1, terminating cover 24 is elongate having opposed side walls 104,106, opposed end walls 108,110, outer surface 112 and opposed inner surface 114, a portion of which forms fluted surface 116 having the same pitch as a cable 62 adapted to be terminated in connector 20.

Spaced legs 120,122 are integral with end Wall 108; spaced legs 124,126 are integral with end wall 110. Legs 120,122,124,126 extend normal to and beyond inner surface 114 and terminate in a latching head at the free ends thereof.

Figure 5:
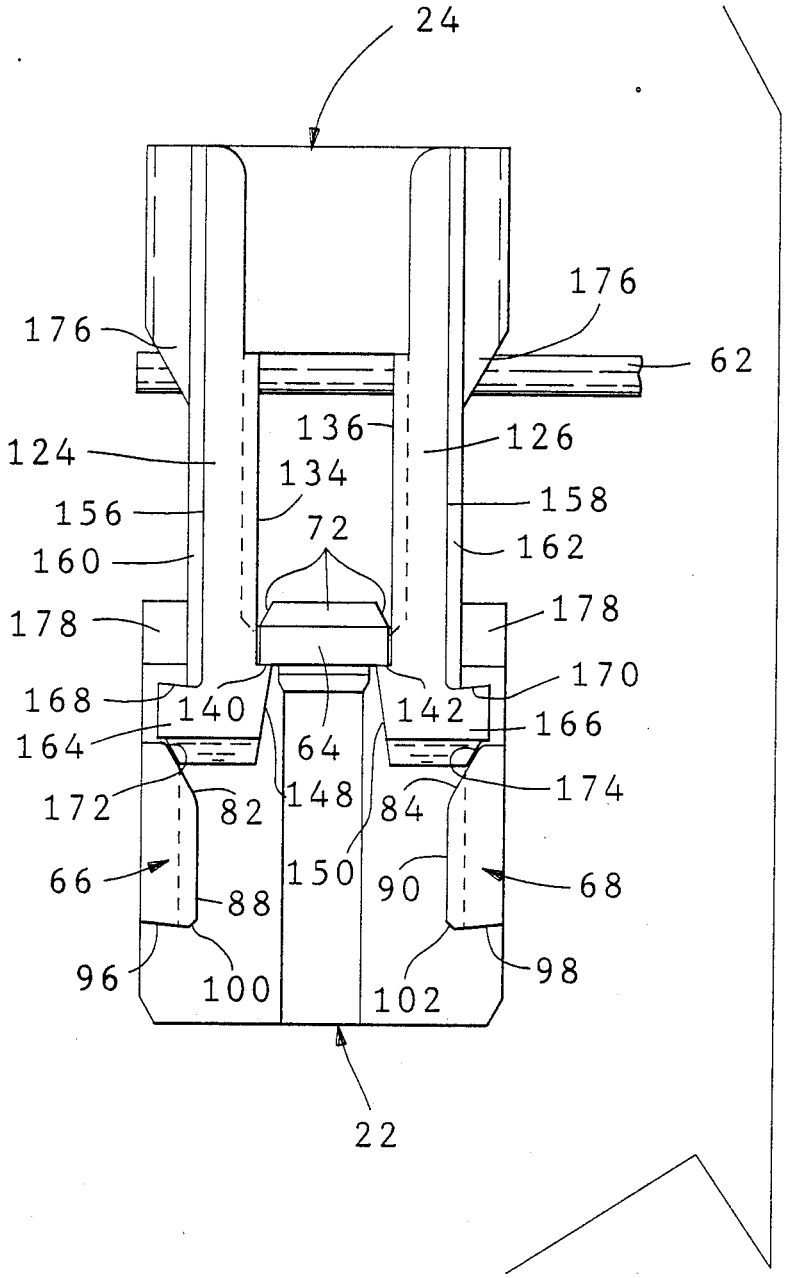
FIG. 5 is an end view of the electrical connector with the terminating cover in a pretermination position.

As best seen in FIG. 5, legs 124,126 have inner side walls 134,136, the upper portion of which are spaced substantially as side edges 74,76 of center protrusion 64 and define shoulders 140,142 near respective free ends as part of respective latching heads 144,146. The lower portion 148,150 of side Walls 134,136 between shoulders 140,142 and the free end, are tapered back toward inner side walls 134,136 in the direction from face 28 toward the free ends, to prevent the lower portions from interfering with each other and to facilitate legs 124,126 passing over chamfer 72 and latching protrusion 64.

Outer side walls 156,158 extend substantially parallel to the upper portions of inner side walls 134,136 and have a laterally extending rib 160,162 through the region of protrusions 66,68 in the terminated position. Ribs 160,162 are received in and are substantially complementary to the wider region of channel 92 within protrusions 66,68.

An outward lateral extension 164,166 on latching head 144,146 defines an upwardly sloping shoulder 168,170, which forms an acute angle with respect to outer side walls 156,158 to engage latching shoulders 96,98 when terminating cover 24 is in the terminated position. Between extensions 164,166 and the free end, an inwardly tapered surface 172,174 is provided for engaging ramped surface 82,84 on protrusions 66,68 when terminating cover 24 is in the pretermination position.

Terminating cover 24 is preassembled onto housing 22 in a pretermination position for ease of threading a ribbon cable between insulation piercing points 54,56 of contacts 40 and inner surface 114, capable of a daisy chain application. As terminating cover 24 is preassembled onto housing 22, lower portions 148,150 of legs 124,126 engage protrusion 64 and chamfer 72. Pressing terminating cover 24 toward housing 22 causes legs 124,126 to resiliently deflect outwardly until shoulders 140,142 pass over corners 78,80 whereupon legs 124,126 resile inwardly to an unbiased position and secure terminating cover 24 to housing 22 in a pretermination position shown in FIG. 5. In the pretermination position, leg 124 is positioned with shoulder 140 received against latching surface 70, side wall 134 against side edge 74 of protrusion 64 and tapered surface 172 wedged against ramped surface 82. Similarly, leg 126 is positioned with shoulder 142 received against latching surface 70, side wall 136 against side edge 76 of protrusion 64 and tapered surface 174 wedged against ramp surface 84. In this pretermination position, there is sufficient space between insulation piercing points 54,56 of contacts 40 and inner surface 114 for threading a ribbon cable 62 and positioning it to terminate to connector 20.

Cable guides 176 extend from inner surface 114 along legs 120,122,124,126 to guide cable 62 during insertion into connector 20 as well as during positioning of cable 62 in fluted surface 116. Guides 176 are received in recesses 178 in housing 22. Detents 180 are provided for latching to a complementary connector (not shown), such as part number 499910 sold by the assignee.

Figure 6:
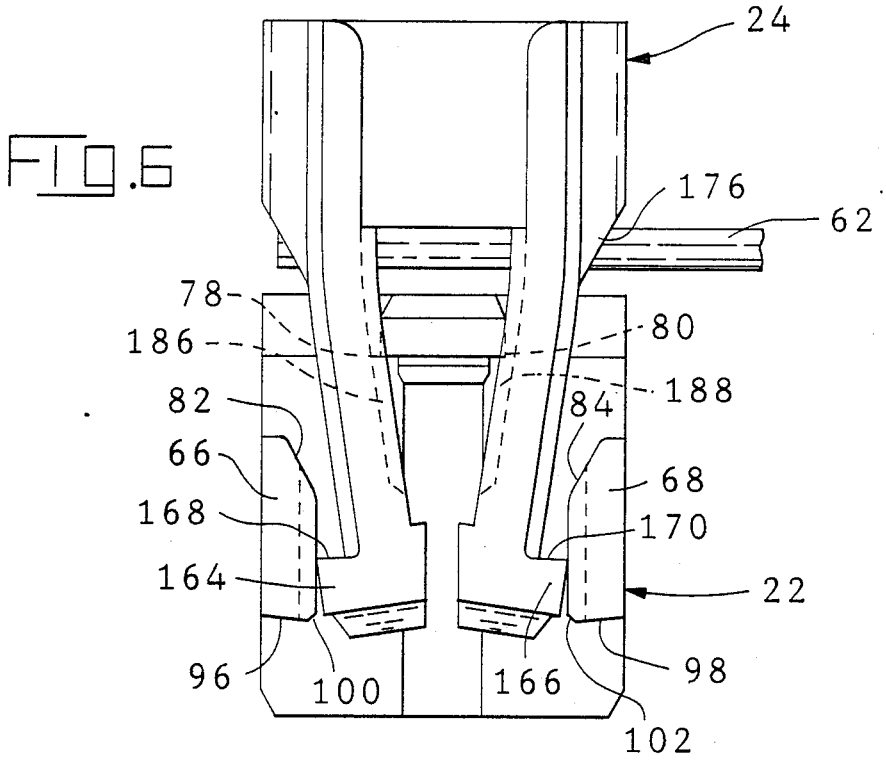
FIG. 6 is an end view of the electrical connector with the terminating cover in the process of being moved from the pretermination position to the termination position.

With a ribbon cable 62 threaded between surface 116 of terminating cover 24 and conductor receiving face 28, more specifically insulation piercing points 54,56 of contacts 40, and positioned for termination, terminating cover 24 is moved from a pretermination position to a terminating position to terminate individual conductors 60 of ribbon cable 62 to respective contacts 40 in a known manner, and to latchingly secure terminating cover 24 to housing 22 in the terminated position. As terminating cover 24 is moved toward housing 22 to terminate cable 62, the free ends of legs 124,126 bend inwardly, toward the other leg as tapered surface 172 slidingly passes over ramped surface 82. Simultaneously, side wall 134 slidingly moves along side edge 74. Similarly, tapered surface 174 slidingly passes over ramped surface 84. Simultaneously, side wall 136 slidingly moves along side edge 76. Legs 124,126 resiliently deflect as shown in FIG. 6, and may have a chamfer 186,188 to receive respectively corners 78,80 to reduce the amount of bending legs 124,126 are subjected to and thus are stress relieving.

Figure 7:
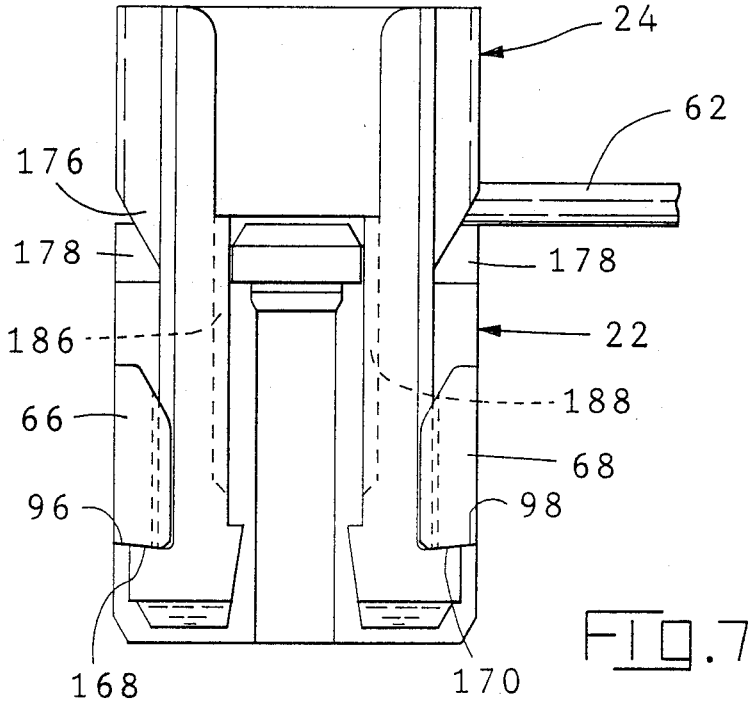
FIG. 7 is an end view of the electrical connector having a cable terminated therein, with the terminating cover positioned in the terminated position.

When outward lateral extensions 164,166 pass corners 100,102, upward sloping shoulders 168,170 slide along and engage upwardly sloping latch shoulders 96,98 as legs 124,126 resile outwardly laterally toward side walls 30,32, causing ribs 160,162 to enter the wider portion 92 of channel 86. Terminating cover 24 is thus latchingly secured to housing 22 in a terminated position shown in FIGS. 7 and 8, with legs 124,126 substantially unbiased. Any force attempting to pull terminating cover 24 away from housing 22 causes upwardly sloping shoulders 168,170 to engage upwardly sloping latch shoulders 96,98 causing latching heads 144,146 to separate, thereby enhancing the latching of terminating cover 24 to protrusions 66,68 and hence to housing 22.

Figure 8:
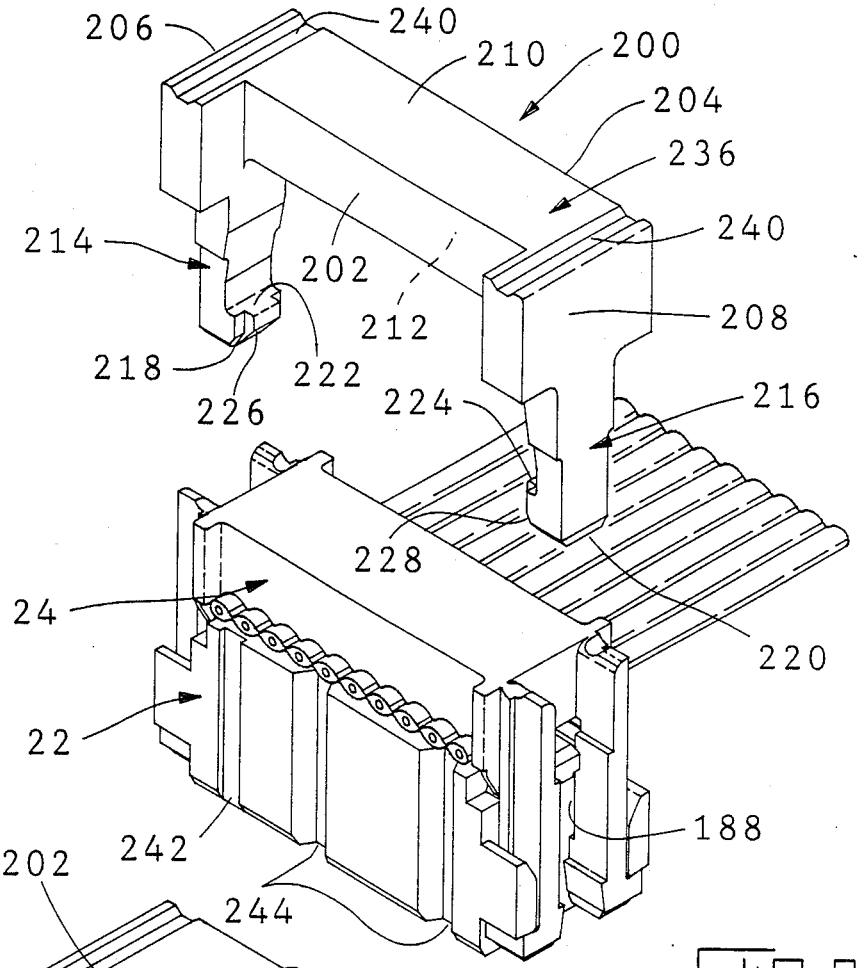
FIG. 8 is an isometric view of the connector having a cable terminated therein, with a strain relief member exploded therefrom.

FIG. 8 shows a connector 20 with a ribbon cable 62 terminated thereto and a strain relief member 200 exploded therefrom. Member 200 is elongate having opposed side walls 202,204, opposed end walls 206,208, outer surface 210 and opposed inner surface 212. Latch arms 214,216 extend to distal ends 218,220 and have respectively latch shoulders 222,224 to cooperate with and engage latching surface 70 and its counterpart on end wall 34, to secure strain relief member 200 to housing 22. Latch arms 214,216 have tapered surface 226,228 which engages chamfer 72 to assist in the distal end 218,220 bending outwardly to ride over center protrusion 64, thence resiling inwardly. Latch arms 214,216 substantially span the distance between side wall 134 of leg 124 and side wall 136 of leg 126.

Strain relief member 200 may be utilized to provide strain relief to the insulation displacement terminations of conductors 60 to contacts 40 by folding cable 62 over outer surface 112 of terminating cover 24 and guiding latch arm 214 between legs 120 and 122, as well as latch arm 216 between spaced legs 124 and 126. Cable terminating cover 24 is pressed further toward housing 22 until the cable is clamped between outer surface 112 of terminating cover 24 and inner surface 212 of strain relief member 200, with latch shoulders 222,224 engaging respective latching surfaces, as shown in FIGS. 9, 10 and 11.

Figure 9:
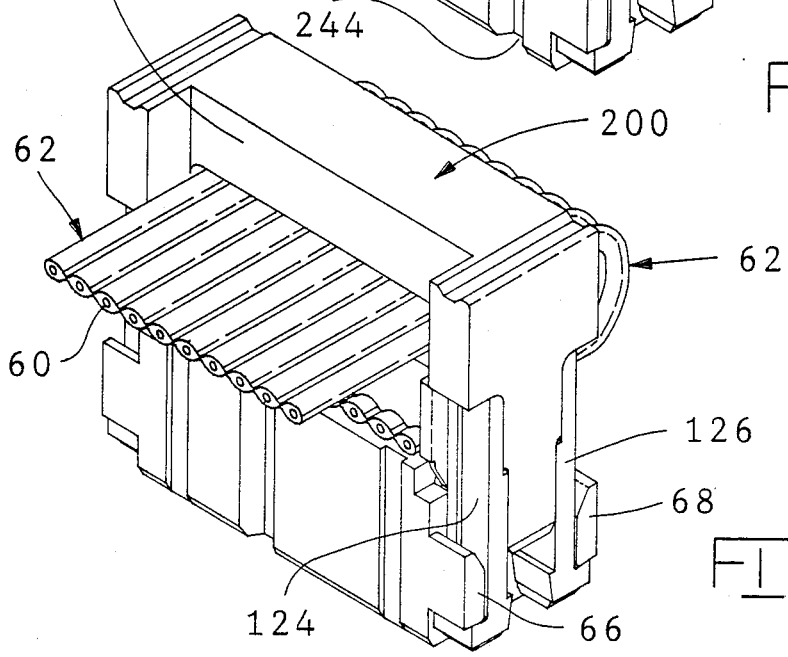
FIG. 9 is an isometric view showing the cable folded back over the terminating cover and clamped by the strain relief member secured to the housing.
Figure 10:
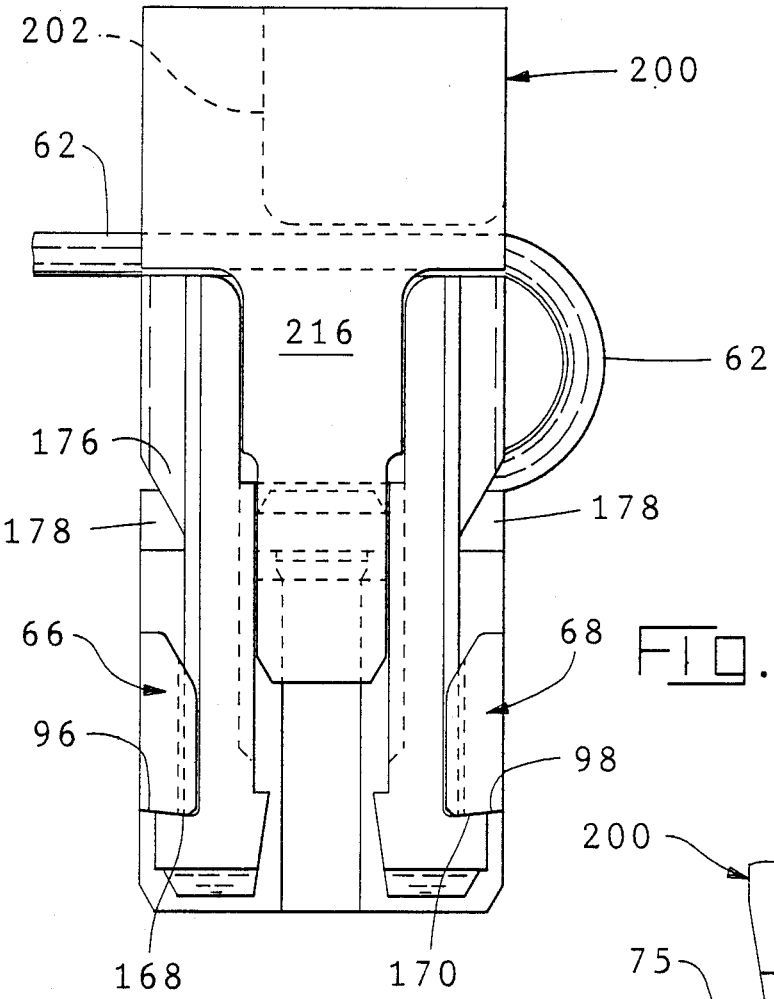
FIG. 10 is an end view showing the strain relief latch in phantom.
Figure 11:
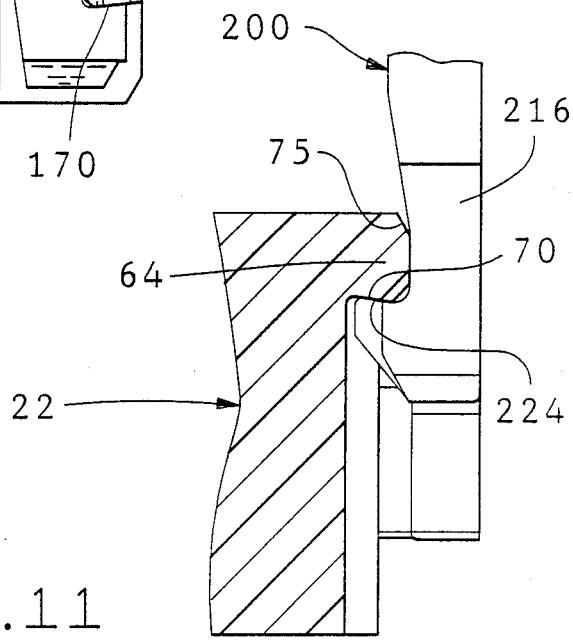
FIG. 11 is a partial sectional view of the housing showing the strain relief latched to the housing.

As best seen in FIGS. 9 and 10, since latch arms 214,216 substantially span the distance between side walls 134 and 136, when strain relief member 200 is employed, the latch arms 214,216 thereof further prevent latching heads 144,146 from releasing from outer protrusions 66,68.

Cross member 236 is off-center with respect to a plane of symmetry passing through latch arms 214,216. A force on cable 62 transferred to strain relief member 200 causes a moment about the intersection of side walls 202 and inner surface 212. With cross member 236 offset such that side wall 202 is close to the plane of symmetry passing through latch arms 214,216, the moment is reduced and therefore more effective strain relief is provided.

Channels 240 in outer surface 210 of strain relief member 200 provide grooves in which a latch member of a complementary connector to which connector 22 is mated may latch. Groove 242 indicates the number one conductor position while grooves 244 are polarizing grooves to assure proper orientation of connector 20 in a mating connector.

We claim:

1. An electrical connector for terminating multiconductor cable, comprising:

a housing having a cable receiving face, opposed side walls and an end wall, said end wall having first, second and third protrusions extending therefrom, said first protrusion centrally located with respect to said side walls and proximate said cable receiving face, said first protrusion defining a latching surface facing in a direction substantially away from said cable receiving face, said second and third protrusions located proximate respective side walls, with said second and third protrusions each defining a sloped surface angled toward the other protrusion in a direction away from said cable receiving face and a latch shoulder facing away from said cable receiving face; and a terminating cover having first and second spaced latch arms extending therefrom to distal ends which are deflectable toward one another, said terminating cover defining an inner surface, said latch arms each having first and second latch means proximate said distal end and facing in a direction substantially towards said cable receiving face, the terminating cover capable of being secured to the housing in first and second positions, in said first position the first latch means on each latch arm engages said latching surface and each said distal end engages a respective said sloped surface such that the inner surface of the terminating cover is spaced from the cable receiving face to permit insertion and alignment of the cable for termination, the terminating cover movable from the first position toward the cable receiving face, the terminating cover securing the cable to the housing in a terminated condition at the second position, with the second latch means of each latch arm engaging a respective said latch shoulder.

2. An electrical connector as recited in claim 1, wherein said first protrusion further comprises spaced side walls and said latch arms define inner side walls spaced substantially as said spaced side walls.

3. An electrical connector as recited in claim 2, further comprising a recess in each of said inner side walls through a portion of the length thereof, for receiving a corner of said first protrusion at the intersection of said latching surface and one of said inner side walls.

4. An electrical connector as recited in claim 1, wherein one of said second latch means forms an acute angle with respect to a said latch arm, whereby the latch means angles upwardly toward said inner surface.

5. An electrical connector as recited in claim 1, wherein the latch shoulder on one of said protrusions forms an upwardly sloping angle, sloping toward said cable receiving face and said side wall adjacent said protrusion.

6. An electrical connector as recited in claim 1, further comprising a strain relief member, said strain relief member defining an inner surface, said strain relief member having a latching member extending therefrom to a free end, said latching member having an engagement shoulder proximate said free end, said engagement shoulder facing said inner surface, said latching member adapted to be received between said spaced first and second latch arms with said engagement shoulder engaging said latching surface, whereby when a cable terminated between the housing and terminating cover is folded over an outer surface of the terminating cover and the strain relief member is received over the cable and secured to the housing, the cable is clamped between the inner surface of the strain relief member and the outer surface of the terminating cover to provide strain relief.

7. An electrical connector as recited in claim 6, wherein said latching member substantially spans between said spaced first and second latch arms, whereby the first and second latch arms are prevented from moving laterally inwardly to release the latch means from respective said latch shoulders, thereby locking the terminating cover on the housing in the terminated position.

8. An electrical connector as recited in claim 1, wherein said second and third protrusions define a channel therebetween, said channel comprising a wider portion adjacent said end wall and a narrower portion remote therefrom, each of said first and second spaced legs having a first portion that is received in the wider portion of the channel and a second portion that is received in the narrower portion of the channel, whereby the first and second legs are maintained adjacent to said end wall.

9. An electrical connector as recited in claim 8, wherein the channel is T-shaped and said legs comprise a rib extending along a portion of a said outer side wall.

10. An electrical connector as recited in claim 1, further comprising guide means extending along said first and second legs for positioning the cable prior to termination.

11. An electrical connector for terminating multiconductor cable, comprising:

a housing having a cable receiving face, opposed side walls defining at their intersection with the cable terminating face major edges and opposed end walls defining at their intersection with the terminating face minor edges, each of said end walls having first, second and third protrusions extending therefrom, each said first protrusion being centrally located with respect to said minor edges and proximate said cable receiving face, each said first protrusion defining a latching surface facing in a direction substantially away from said cable receiving face, said second and third protrusions located proximate respective side walls, with each of said second and third protrusions defining a sloped surface angled toward the other protrusion in a direction away from said cable receiving face and a latch shoulder facing away from said cable terminating face; and a terminating cover, said terminating cover having proximate each end wall first and second spaced latch arms extending therefrom to distal ends, said distal ends proximate each said end wall being detectable toward one another, said terminating cover defining an inner surface, said latch arms each having first and second latch means proximate said distal end and racing in a direction substantially toward said cable receiving face the terminating cover capable of being secured to the housing in first and second positions, in said first position the first latch means on each latch arms engages a respective said latching surface and said distal end engages a respective said sloped surface such that the inner surface of the terminating cover is spaced from the cable receiving face to permit insertion and alignment of the cable for termination, the terminating cover movable from the first position toward the cable receiving face, the terminating cover securing the cable to the housing in a terminated condition at the second position with the second latch means of each latch arm engaging a respective said latch shoulder.

12. An electrical connector as recited in claim 11, wherein each said first protrusion further comprises spaced side walls and said first and second spaced latch arms further comprise inner side walls spaced substantially as said spaced side walls.

13. An electrical connector as recited in claim 12, further comprising a recess in each of said inner side walls through a portion of the length thereof, for receiving a corner of a said first protrusion at the intersection of a said latching surface and one of a said inner side walls.

14. An electrical connector as recited in claim 11, wherein one of said second latch means forms an acute angle with respect to a said latch arm, whereby the latch means angles upwardly toward said inner surface.

15. An electrical connector as recited in claim 11, wherein the latch shoulder on one of said protrusions forms an upwardly sloping angle, sloping toward said cable receiving face and said side wall adjacent said protrusion.

16. An electrical connector as recited in claim 11, further comprising a strain relief member, said strain relief member defining an inner surface, said strain relief member having a latching member extending therefrom to a free end, said latching member having an engagement shoulder proximate said free end, said engagement shoulder facing said inner surface, said latching member adapted to be received between said spaced first and second latch arms with said engagement shoulder engaging said latching surface, whereby when a cable terminated between the housing and terminating cover is folded over an outer surface of the terminating cover and the strain relief member is received over the cable and secured to the housing, the cable is clamped between the inner surface of the strain relief and the outer surface of the terminating cover to provide strain relief.

17. An electrical connector as recited in claim 16, wherein said latching member substantially spans between said spaced first and second latch arms, whereby the first and second latch arms are prevented from moving laterally inwardly to release the latch means from respective latch shoulders, thereby locking the terminating cover on the housing in the terminated position.

18. An electrical connector as recited in claim 11, wherein said second and third protrusions define a channel therebetween, said channel comprising a wider portion adjacent said end wall and a narrower portion remote therefrom, each of said first and second spaced legs having a first portion that is received in the wider portion of the channel and a second portion that is received in the narrower portion of the channel, whereby the first and second legs are maintained adjacent to said end wall.

19. An electrical connector as recited in claim 18, wherein the channel is T-shaped and said legs comprise a rib extending along a portion of an outer side wall.

20. An electrical connector as recited in claim 11, further comprising guide means extending along said first and second legs for positioning the cable prior to termination.

* * * * *